United States Patent [19]

Owen et al.

[11] 4,352,380

[45] Oct. 5, 1982

[54] DECORATIVE SHEETING FABRIC

[75] Inventors: James G. Owen; John M. Grimes, both of Eden, N.C.

[73] Assignee: Fieldcrest Mills, Inc., Eden, N.C.

[21] Appl. No.: 171,250

[22] Filed: Jul. 22, 1980

[51] Int. Cl.[3] ..... D03D 15/00; D03D 15/06

[52] U.S. Cl. ..... 139/426 R; 139/416; 28/163; 28/168; 8/114.6

[58] Field of Search ..... 139/420 R, 426 R, 416–418; 57/210; 28/163, 168, 76 T; 8/114.6, 140

[56] References Cited

U.S. PATENT DOCUMENTS

| | | | |
|---|---|---|---|
| 1,955,582 | 4/1934 | Golding | 139/426 R |
| 2,133,237 | 10/1938 | Slayter | 139/420 R |
| 4,191,221 | 3/1980 | Boyer | 139/426 R |

FOREIGN PATENT DOCUMENTS

| | | | |
|---|---|---|---|
| 1262215 | 3/1968 | Fed. Rep. of Germany | 8/114.6 |
| 46-11075 | 3/1971 | Japan | 139/426 R |
| 50-20630 | 7/1975 | Japan | 28/168 |
| 50-83598 | 7/1975 | Japan | 8/114.6 |

*Primary Examiner*—James Kee Chi

*Attorney, Agent, or Firm*—Bell, Seltzer, Park & Gibson

[57] ABSTRACT

A woven sheeting fabric is provided with a variety of unusual and visually appealing decorative patterned effects by forming in the fabric open, shear areas of various size and shape having an appearance contrasting with adjacent, substantially heavier areas. The fabric comprises warp and weft yarns of corespun construction interwoven with one another to form a substantially uniform woven fabric construction. Each of the corespun warp and weft yarns has a continuous multifilament core portion and a sheath portion formed of staple fibers helically wrapped about the core portion to substantially surround and encase the same. The portions of the corespun warp and weft yarns which extend throughout the sheer areas of the fabric have the multifilament core portions thereof exposed and are substantially devoid of sheath fibers and are thus smaller than adjacent portions of the yarns in the heavier areas of the fabric, and the sheer areas of the fabric are thus thinner than the adjacent heavier areas to provide further contrast with the heavier areas.

13 Claims, 7 Drawing Figures

DECORATIVE SHEETING FABRIC

FIELD OF THE INVENTION

This invention relates to a sheeting fabric having a decorative pattern therein formed by areas of the fabric being of differing density or weight and thus of contrasting appearance.

BACKGROUND AND SUMMARY OF THE INVENTION

It is an object of this invention to provide a sheeting fabric which is characterized by having relatively open, sheer areas of an appearance contrasting with adjacent substantially heavier areas and wherein these contrasting areas cooperate to define various decorative patterned effects in the fabric. More particularly, it is an object of this invention to provide novel decorative patterned effects in a woven sheeting fabric by forming in the fabric, sheer substantially transparent areas of an appearance contrasting with adjacent substantially opaque heavier areas.

It is a further object of this invention to produce decorative fabrics of this type by a simple and relatively economical process.

In accordance with this invention textile sheeting fabrics having the aforementioned contrasting sheer and heavier areas are formed of yarns of corespun construction interwoven with one another to form a substantially uniform woven fabric construction throughout both the sheer areas and the heavier areas. Each of the corespun yarns has a continuous multifilament core portion and a sheath portion formed of staple fibers helically wrapped about the core portion to substantially surround and encase the same. The portions of the corespun yarns which extend throughout the sheer areas have the multifilament core portions thereof exposed and are substantially devoid of sheath fibers and are thus smaller than adjacent portions of the yarns in the heavier areas. The sheer areas in the fabric are thus thinner than the adjacent heavier areas to provide further contrast with the adjacent heavier areas.

Sheeting fabrics suitable for use in this invention are of a plain weave construction with a thread count of at least about 125 threads per square inch and typically have a weight of about 3.7 to 4.4 ounces per square yard; they are generally of a substantially balanced construction, with the number of picks per inch being from about 80% to about 100% of the number of warp ends per inch. In a preferred aspect, the decorative sheeting fabric in accordance with this invention comprises a woven percale sheeting fabric having a uniform woven fabric construction of at least about 180 threads per square inch throughout both the sheer areas and the heavier areas, and wherein the corespun yarns have a yarn count of about 34/1 to about 40/1 cotton count and are comprised of a polyester multifilament core portion and the sheath portion being formed of cellulosic fibers.

The decorative patterned effects are produced in the fabric by applying to selected areas of the fabric an oxidizing agent which will carbonize and destroy the readily carbonizable sheath fibers of the corespun yarns while leaving the multifilament core portion intact. Preferably this is accomplished by printing the fabric with a paste containing the desired oxidizing agent, and thereafter heating the printed fabric to activate the oxidizing agent and cause it to attack and destroy the carbonizable sheath fibers.

Several early patents (e.g. U.S. Pat. No. 725,823; 1,223,018; 1,804,529 and 1,834,339) have disclosed how decorative, lacelike effects can be produced in a fabric by forming the fabric either wholly or partially of yarns which are carbonizable and wherein the carbonizable yarns are dissolved away throughout the fabric or in selected areas to leave an open or lacelike pattern where the selected carbonizable yarns were removed.

The present invention differs fundamentally over these aforementioned early patents in that the fabric is formed of yarns of corespun construction containing a non-carbonizable core component and readily carbonizable fibers forming a sheath surrounding and encasing the non-carbonizable core portion. Further, the yarns are uniformly distributed throughout the fabric both in the areas where the carbonizable fibers are removed and in the other areas of the fabric where the carbonizable sheath fibers are left intact. The removal of the sheath fibers in selected areas causes these areas to be thinner than the adjacent heavier areas and with the exposed core filaments being spaced apart from one another to provide a sheer substantially transparent appearance contrasting with the adjacent heavier and substantially opaque areas. Since the fabric is of a uniform construction throughout both the sheer and the heavier areas, and with the core filaments remaining intact, the fabric is not significantly weakened by the carbonizing treatment and the fabric can thus be used in applications requiring excellent tensile strength, such as in a bedsheet for example.

A particularly suitable fabric construction for use in producing the patterned fabrics of the present invention is disclosed in commonly owned U.S. Pat. No. 4,191,221 issued Mar. 4, 1980. This patent discloses a woven percale sheeting fabric formed of corespun yarns and wherein the core component is formed of multifilament polyester and the sheath component is formed of cellulosic staple fibers helically wrapped about the multifilament core portions so that the cellulosic fibers are located at the surface of the yarns to provide improved aesthetic appeal and improved physical characteristics to the fabric.

The present invention provides for an essentially unlimited variety of different pattern effects by varying the size and design of the substantially transparent sheer areas and by employing various printed or dyed colors on the fabric. For example, the substantially transparent sheer areas may be formed in relatively narrow widths outlining a particular design in the heavier substantially opaque portions of the fabric and forming ornate simulated lacelike appearances in the fabric. Alternatively, the sheer, substantially transparent areas may be formed of a relatively large size and may themselves define a desired pattern in the fabric. These variations in size and appearance of the sheer areas, either alone or in combination with variations in color on the fabric, provide patterned fabrics of unusual and visually appealing characteristics.

In achieving various color effects in the fabric, the print paste containing the oxidizing agent can also include pigments or dyes so that the exposed multifilament core portions in the sheer areas of the fabric are dyed or colored, while the corespun yarns in the heavier areas are either undyed or dyed a contrasting color. Further, various cross-dyed effects can be achieved by taking advantage of the different dye affinities of the continuous multifilament core portion of the yarn and the staple fibers of the sheath portion of the yarn.

The patterned sheeting fabrics of this invention may be used in a variety of applications, such as in bedsheets, pillowcases, dust ruffles, comforters, coverlets, and various other applications.

BRIEF DESCRIPTION OF THE DRAWINGS

Some of the objects and features of the invention having been described, other and further objects and features of the invention will become apparent from the following detailed description and from the accompanying drawings, in which.

DESCRIPTION OF ILLUSTRATIVE EMBODIMENT

Figure 1:
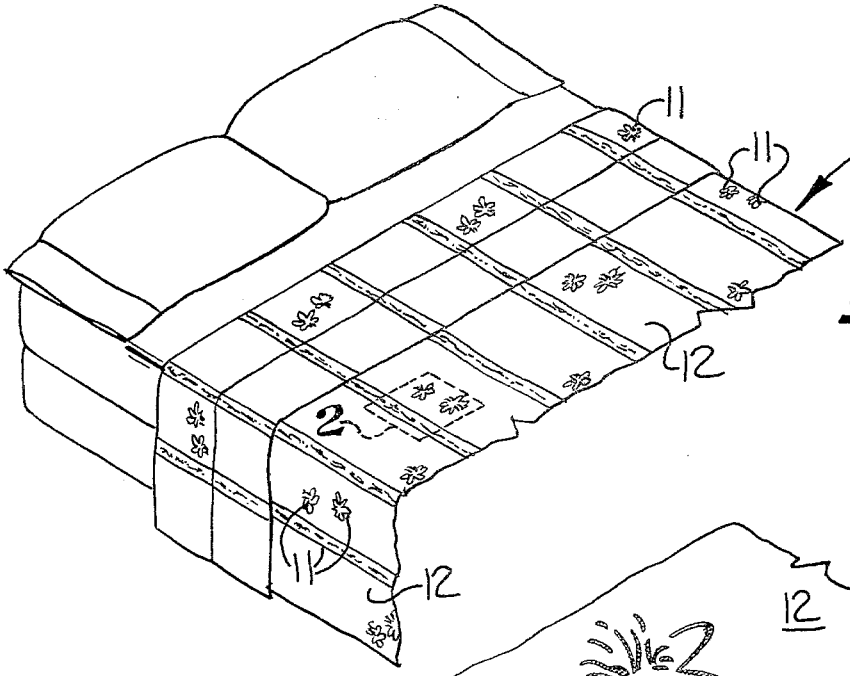
FIG. 1 is a perspective view of a bed which is provided with a bedsheet formed of the woven decorative sheeting fabric of this invention.
Figure 2:
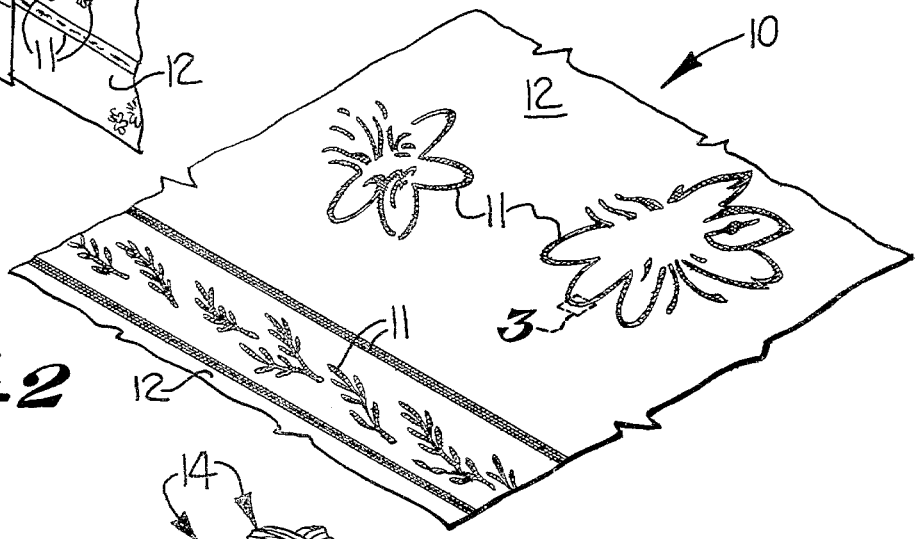
FIG. 2 is an enlarged perspective view of the portion of the fabric in FIG. 1 indicated by the numeral 2.

Referring more particularly to the drawings, FIG. 1 illustrates a bedsheet formed from a woven fabric 10 in accordance with the invention, and wherein the fabric includes sheer, substantially transparent areas indicated by the reference numeral 11 and adjacent substantially heavier areas 12 which cooperate with the sheer areas 11 to give the fabric its patterned appearance. As best seen in FIGS. 1 and 2, the particular pattern illustrated is a flowered design and is characterized by the sheer, substantially transparent areas 11 being relatively narrow and with the narrow sheer areas forming a small detailed border pattern in certain areas, and in other areas tending to outline flower patterns, such that the flower patterns are formed in the heavier, substantially opaque areas 12 of the fabric. The resulting pattern thus gives an openwork or simulated lacelike appearance to the fabric.

Figure 3:
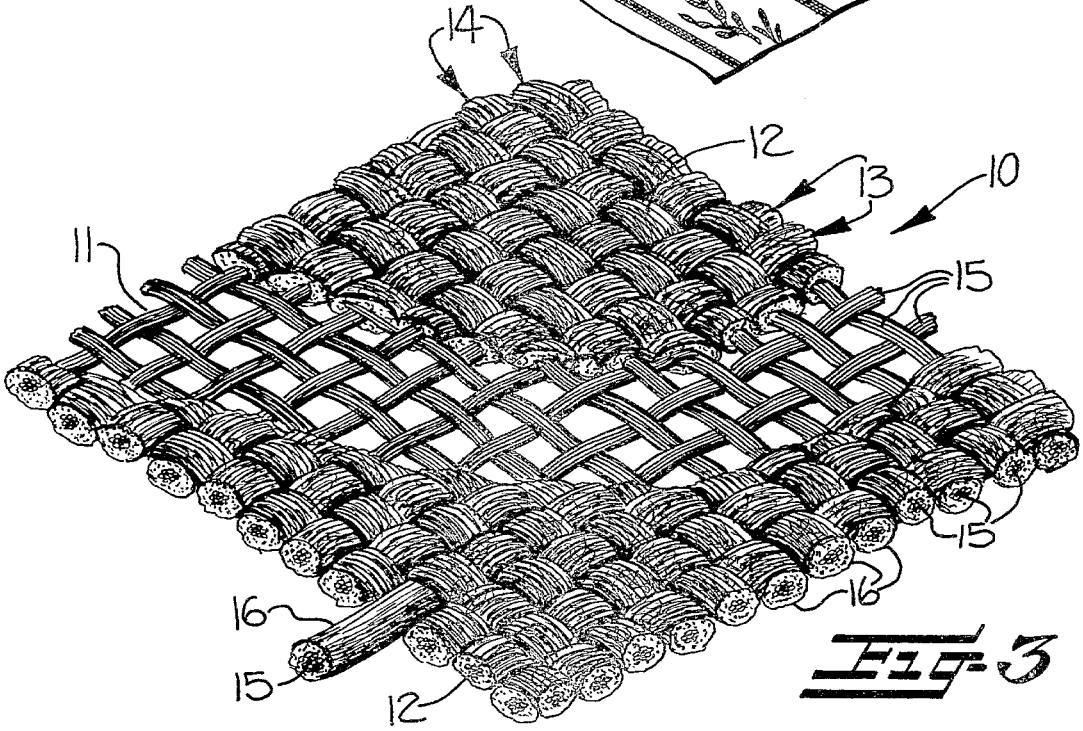
FIG. 3 is a greatly enlarged perspective view showing the portion of the fabric in FIG. 2 indicated by the numeral 3.

As seen more clearly in the enlarged scale view of FIG. 3, the woven fabric 10 is formed of interwoven warp and weft yarns 13, 14 respectively, which are tightly interwoven to form a fabric of a plain weave and a substantially balanced construction, with the number of picks per inch being from about 80% to about 100% of the number of warp ends per inch and with the fabric and the fabric having a weight within the range of about 3.7 to about 4.4 ounces per square yard.

Each of the warp and weft yarns 13, 14 is of a corespun construction and includes a continuous multifilament core portion 15 and a sheath portion 16 formed of staple fibers helically wrapped about the core portion 15 to surround and encase the same. The multifilament core portion 15 is formed of a noncarbonizable synthetic polymer material such as nylon, acrylic or polyester. The staple fibers of the sheath portion 16 are formed of a readily carbonizable material, such as cotton, rayon, linen and acetate.

As seen in FIG. 3, the tightly interwoven warp and weft yarns 13, 14 have their sheath portions 16 positioned in contiguous relation with adjacent yarns in the heavier areas 11 of the fabric to thus render these areas substantially opaque. In the sheer areas 11, however, the warp and weft yarns 13, 14 have their core portions 15 exposed and the yarns are substantially devoid of sheath fibers. The portions of the warp and weft yarns 13, 14 in the sheer areas 11 are thus smaller than in the adjacent heavier areas, so that these areas of the fabric are thinner, and the warp and weft yarns extend in spaced-apart relation from adjacent yarns to give these areas of the fabric their sheer and substantially transparent appearance.

Figure 4:
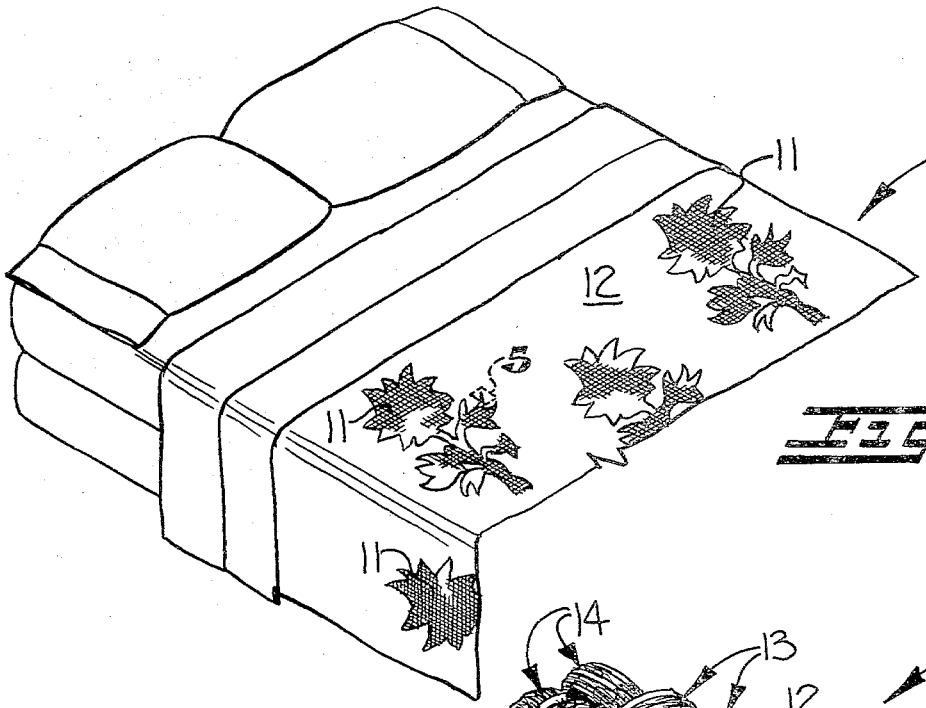
FIG. 4 is a view similar to FIG. 1 but showing a bedsheet formed from a decorative woven sheeting fabric in accordance with this invention and characterized by having relatively large sheer areas therein.
Figure 5:
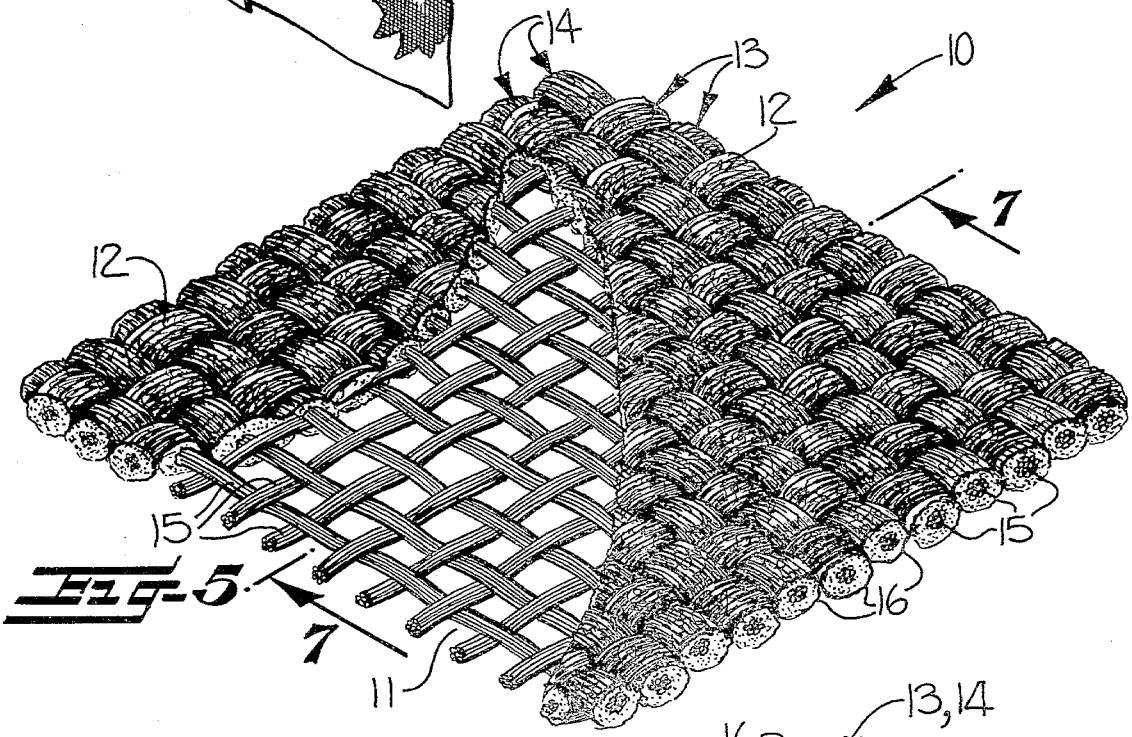
FIG. 5 is a greatly enlarged perspective view of that portion of the fabric in FIG. 4 indicated by the numeral 5.
Figure 6:
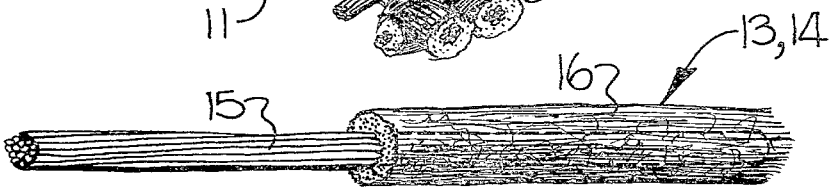
FIG. 6 is a perspective view showing one of the corespun yarns utilized in the woven fabric.
Figure 7:
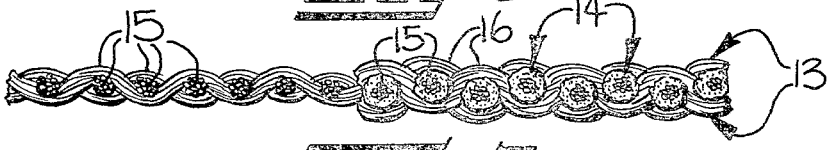
FIG. 7 is a cross-sectional view of the fabric taken substantially along the line 7—7 of FIG. 5.

The patterned fabric shown in FIGS. 4 and 5 is of a similar construction and differs over that shown in FIGS. 1 to 3 only in the particular pattern imparted to the fabric. To avoid repetitive description, the same reference characters are used to identify corresponding elements.

In the pattern of FIGS. 4 and 5, the sheer substantially transparent areas 11 are considerably larger than the corresponding areas of the previously described pattern. In this embodiment the pattern areas are defined by the sheer areas 11, in contrast to the pattern effect of FIGS. 1 to 3 where the sheer areas generally outline the pattern and the pattern is formed in the substantially opaque areas 12.

Regardless of the particular patterns formed in the fabric, it is important, in order to provide the desired contrast in appearance between the sheer, substantially transparent areas 11 and the heavier substantially opaque areas 12 while also obtaining the physical properties and appearance characteristics which are necessary in a sheeting fabric, that the corespun yarns have a construction within certain defined parameters. More particularly, the continuous multifilament core portion of the yarn is desirably formed of a continuous multifilament yarn with a sufficiently low denier per filament so as to maintain suppleness and pliability to the yarn and in turn to the woven fabric itself. Multifilament yarn of two to four denier per filament has been found to provide a desirable level of suppleness and pliability to the yarn and fabric and to also provide adequate tensile strength in the finished fabric, especially in the areas where the surrounding sheath fibers have been removed.

In order to obtain a constrast in thickness and fabric density between the sheer areas and the heavier areas, as well as to enable the sheath fibers to fully surround and encase the core portion, the carbonizable sheath fibers should comprise a minimum of 50% by weight of the yarn, and desirably should comprise at least 65% by weight of the yarn. To achieve this minimum desired level of sheath fibers while keeping the total yarn count within the desired range, the total denier of the multifilament core portion becomes very important. Preferably, the multifilament core portion has a total denier of about 40 to 90.

Depending upon the particular end use for the decorative sheeting fabric, the fabric may be either of a muslin or percale construction. For a muslin construction, the sheeting fabric would typically have a finished thread count of at least 125, preferably about 130, and a weight of about 3.9 to about 4.4 ounces per square yard. The yarn count would be in the range of about 22/1 to 26/1 cotton count, and with the staple sheath fibers comprising carded fibers. For a percale construction, the sheeting fabric would typically have a finished thread count of at least about 180 threads per square inch and the fabric weight would range from about 3.7 to about 3.9 ounces per square yard. For fabrics with a thread count of about 180, the corresponding yarn count should preferably be about 34/1 to 37/1 cotton count. For fabrics with a count substantially above 180, e.g. 200 threads per inch, yarn counts as fine as about 40/1 may be employed. For a percale sheeting fabric, the multifilament core portion of the corespun yarn preferably has a total denier of about 40 to 50 and the staple sheath fibers preferably comprise combed fibers.

Unlike conventional percale sheeting fabric construction which normally has coarser warp yarns than filling yarns, the present invention preferably utilizes warp and filling yarns of the same yarn count. The fabric is woven so that when finished, the picks per inch are approximately 10 to 20% less than the warp ends per inch.

Preferred corespun yarns for use in this invention have a multifilament polyester core portion of a total denier and denier per filament as noted above, and have a cellulosic fiber sheath portion. The staple fibers used in the sheath portion of the corespun yarn preferably have a staple length of at least 1 1/16 inch. Where ravon is used as the cellulosic fibers, the rayon should have a staple length of from 1¼ to 2 inches and should be from 1.25 to 2.25 denier, preferably 1.5 denier, 1 9/16 inch staple length. Where cotton fibers are used as the carbonizable cellulosic sheath fibers, it is desirable to use cotton fibers having a staple length of at least 1 1/16 inch. Commonly owned U.S. Pat. No. 4,191,221 issued Mar. 4, 1980 discloses a particularly suitable woven sheeting fabric for use in the present invention. This fabric is formed of corespun yarns having a multifilament polyester core component and cellulosic staple fibers as the sheath component.

The sheer substantially transparent areas 11 are produced by contacting those areas of the fabric with an oxidizing agent which is capable of carbonizing the carbonizable sheath fibers while leaving the core portion of the yarn intact. The oxidizing agents are preferably applied to the fabric by printing. Suitable oxidizing agents which can be used include sodium bisulfate, aluminum chloride, stannous chloride, and sulfuric acid. The oxidizing agents can be printed on the fabric in conjunction with conventional thickeners and binders and using conventional printing methods known to those skilled in the art, such as flatbed screen printing, rotary screen printing, engraved roll printing or block printing. Viscosity and penetration of the oxidizing print are adjusted to develop fine line definition as well as to control wicking into unprinted areas. The printed fabric is dried in an oven by other suitable means in order that the printed area is not touched by anything that might cause the print to smear. Upon heating, the oxidizing agent is converted into its active form and becomes effective to oxidize or carbonize the cellulosic portion of the corespun yarns.

An exemplary print paste formulation is as follows (all percentages by weight):

3.0% nonionic etherfied guar gum
5.0% humectant
10.5% sodium bisulfate
0.5% sodium di-(2-ethylhexyl) sulfosuccinate
0.2% antifoaming agent
0.3% sighting color In the above formulation, the sodium bisulfate, upon heating in the presence of water, converts to sulfuric acid, which oxidizes the cellulosic portion of the yarn. The carbonized cellulosic fiber is removed by scouring with hot water containing a surfactant.

The patterned fabric can then be dyed with dyes suitable to the fiber. Contrasting color dyes can be used for the synthetic and cellulosic fibers to produce a cross-dyed effect. After dyeing, the fabric can be finished by conventional methods.

Novel and interesting pattern effects can also be obtained by incorporating dyes or pigments in the print paste, so that the print paste serves not only to carbonize and remove the cellulosic portion, but to impart a desired color effect to the remaining multifilament core portion. By way of example, in the pattern shown in FIG. 4, the respective relatively large sheer areas 11 can be formed of a single common color, of different colors, or of multiple colors by incorporating into the print paste, in addition to the oxidizing agent, suitable disperse dyestuffs which will sublime into the polyester core component during the drying and carbonizing step. Acid dyes may be used to color a nylon core component in a similar way. The opaque portions 12 may be left undyed, or may be printed in a desired pattern with a print paste containing pigments or dyes suitable for the sheath fibers.

In the drawings and specification, there have been set forth preferred embodiments of the invention, and although specific terms are employed, they are used in a generic and descriptive sense only and not for purposes of limitation.

That which is claimed is:

1. A decorative woven sheeting fabric characterized by having relatively open, sheer areas of an appearance contrasting with adjacent, substantially heavier areas to define a patterned effect in the fabric, said fabric comprising warp and weft yarns of corespun construction interwoven with one another to form a substantially uniform woven fabric construction of a weight of about 3.7 to about 4.4 ounces per square yard, each of said corespun warp and weft yarns having a continuous multifilament core portion and having a sheath portion formed of staple fibers helically wrapped about the core portion to substantially surround and encase the same, the portions of the corespun warp and weft yarns which extend throughout said sheer areas having the multifilament core portions thereof exposed and being substantially devoid of sheath fibers and thus being smaller than adjacent portions of the yarns in said heavier areas, and the sheer areas in said fabric thus being thinner than the adjacent heavier areas to provide further contrast with the adjacent heavier areas.

2. A decorative fabric according to claim 1 wherein said continuous multifilament core portion of the corespun yarn is comprised of noncarbonizable synthetic filaments and the fibers of said sheath portion comprise readily carbonizable fibers.

3. A decorative fabric according to claim 1 wherein said warp and weft yarns are interwoven to form a substantially balanced fabric construction with the number of picks per inch being from about 80% to about 100% of the number of warp ends per inch and the fabric having at least about 125 threads per square inch.

4. A decorative fabric according to claim 1 wherein said continuous multifilament core portion of the corespun yarn is comprised of synthetic filaments of 2 to 4 denier per filament and a total denier of about 40 to 90.

5. A decorative fabric according to claim 1 wherein the fibers of said sheath portion comprise at least 50 percent by weight of the corespun yarn.

6. A decorative fabric according to claim 1 wherein said continuous multifilament core portion of the corespun yarn is formed of a synthetic polymer having a different dye affinity from the staple fibers of said sheath portion of the yarn.

7. A decorative fabric according to claim 6 wherein the sheath fibers in said heavier areas are dyed a color contrasting to the color of the exposed multifilament core portions in said sheer areas, and wherein said exposed core portions are undyed.

8. A decorative fabric according to claim 6 wherein the sheath fibers in said heavier areas are dyed a color contrasting to the color of the exposed multifilament core portions in said sheer areas, and wherein said exposed core portions are also dyed.

9. A decorative fabric according to claim 1 wherein the exposed multifilament core portions in said sheer areas are dyed and the corespun yarns in said heavier areas are undyed.

10. A decorative woven percale sheeting fabric characterized by having substantially transparent sheer areas of an appearance contrasting with adjacent, substantially opaque heavier areas to define a patterned effect in the fabric, said fabric comprising warp and weft yarns of corespun construction interwoven with one another to form a substantially uniform woven fabric construction of at least about 180 threads per square inch throughout both said sheer areas and said heavier areas, each of the corespun warp and weft yarns having a core portion formed of a noncarbonizable multifilament synthetic polymer of about 40 to 50 total denier and having a sheath portion formed of carbonizable staple fibers helically wrapped about the multifilament core portion to substantially surround and encase the same and comprising at least 50 percent by weight of the corespun yarn, the portions of said warp and weft yarns which extend throughout said heavier areas being tightly interwoven and having the sheath fibers of adjacent yarns positioned in contiguous relation to render said heavier areas of the fabric substantially opaque, and the portions of said warp and weft yarns which extend throughout said sheer areas having the multifilament core portions thereof exposed and being substantially devoid of sheath fibers and thus being smaller than the adjacent portions of the yarns in said heavier areas, and with adjacent yarns in said sheer areas thus being spaced apart from one another to render said areas sheer and substantially transparent in contrast with the opacity of the adjacent heavier areas.

11. A decorative woven fabric according to claim 10 wherein said multifilament core portion of the corespun yarn comprises continuous multifilament polyester and the staple fibers of said sheath portion comprise cellulosic fibers.

12. A decorative woven fabric according to claim 11 wherein said corespun warp and weft yarns have a yarn count of about 34/1 to about 40/1 cotton count.

13. A decorative woven percale sheeting fabric characterized by having substantially transparent sheer areas of an appearance contrasting with adjacent, substantially opaque heavier areas to define a patterned effect in the fabric, said fabric comprising warp and weft yarns of corespun construction having a yarn count of about 34/1 to about 40/1 cotton count and being interwoven with one another to form a uniform woven fabric construction of at least about 180 threads per square inch throughout both said sheer areas and said heavier areas, and wherein the picks per inch are approximately 10 to 20 percent less than the warp ends per inch, each of the corespun warp and weft yarns having a core portion formed of multifilament polyester of 2 to 4 denier per filament and a total denier of about 40 to 50, and having a sheath portion formed of cellulosic fibers of a staple length of at least 1 1/16 inch, the cellulosic fibers being helically wrapped about the multifilament polyester core portion to substantially surround and encase the same, said cellulosic fibers comprising at least 65 percent by weight of the corespun yarn, the portions of said warp and weft yarns which extend throughout said heavier areas having the cellulosic sheath fibers of adjacent yarns positioned in contiguous relation to render said heavier areas substantially opaque, and the portions of said warp and weft yarns which extend throughout said sheer areas having the multifilament polyester core portion thereof exposed and being substantially devoid of sheath fibers and thus being smaller than the adjacent portions of the yarns in said heavier areas, and with adjacent yarns in said sheer areas thus being spaced apart from one another to render said areas sheer and substantially transparent in contrast with the opacity of the adjacent heavier areas.

* * * * *